US006945026B1

(12) United States Patent
Hanna

(10) Patent No.: US 6,945,026 B1
(45) Date of Patent: Sep. 20, 2005

(54) FIBRE YARN AND ROPE PRODUCTION

(75) Inventor: Ashley Robert Hanna, Christchurch (NZ)

(73) Assignee: Dyers Road Re-Manufacturing and Imports Limited, Christchurch (NZ)

( * ) Notice: Subject to any disclaimer, the term of this patent is extended or adjusted under 35 U.S.C. 154(b) by 0 days.

(21) Appl. No.: 09/857,326

(22) PCT Filed: Dec. 3, 1999

(86) PCT No.: PCT/NZ99/00209

§ 371 (c)(1),
(2), (4) Date: Jun. 7, 2002

(87) PCT Pub. No.: WO00/32857

PCT Pub. Date: Jun. 8, 2000

(30) Foreign Application Priority Data

Dec. 3, 1998 (NZ) ..... 333184

(51) Int. Cl.[7] ..... D02G 3/36

(52) U.S. Cl. ..... 57/3; 57/6; 57/204; 57/210; 57/293

(58) Field of Search ..... 57/1 R, 3, 6, 10, 57/12, 200, 204, 207, 210, 230, 293; 66/81, 66/192, 195

(56) References Cited

U.S. PATENT DOCUMENTS

| | | | | |
|---|---|---|---|---|
| 3,078,654 | A * | 2/1963 | Marshall | 57/6 |
| 3,565,127 | A * | 2/1971 | Doyle et al. | 139/426 R |
| 3,577,873 | A * | 5/1971 | Waters | 57/205 |
| 4,309,869 | A * | 1/1982 | Boyce | 57/293 |
| 4,866,924 | A * | 9/1989 | Stahlecker | 57/243 |
| 6,035,668 | A * | 3/2000 | Akopian | 66/81 |

* cited by examiner

*Primary Examiner*—John J. Calvert
*Assistant Examiner*—Shaun R Hurley
(74) *Attorney, Agent, or Firm*—Woodcock Washburn LLP

(57) ABSTRACT

An unspun yarn including a longitudinal main rope body formed from a least one fibre assembly of substantially untwisted and parallel fibres, and a least one reinforcing thread helically wound around the rope body and extending therealong in a single longitudinal direction. The direction in which the reinforcing thread is wound around the rope is reversed at predetermined intervals. A method of forming an unspun yarn, including providing a fibre assembly of substantially untwisted and parallel fibres and reinforcing thread, forming a longitudinal main rope body; intermittently imparting opposing twists to alternate sections of the rope body while drawing the reinforcing thread longitudinally into surface contact with a twisted section of the rope body, allowing the twisted section to engage the adjacent section of the reinforcing thread, releasing the opposing twists of the rope body causing the engaged reinforcing thread to wrap the rope body.

14 Claims, 5 Drawing Sheets

FIBRE YARN AND ROPE PRODUCTION

TECHNICAL FIELD

This invention relates to the production of yarns and ropes, and more particularly relates to the production of relatively high strength yarns utilising wool or other fibre slubbings or like which are loosely joined drawn and unspun or partially spun/intertwined fibres or filaments.

BACKGROUND

The majority of yarns produced at present are spun with real twist. In one method of manufacture, spun yarns are produced by firstly straightening and untangling fibres by a carding-type process, to produce a flat web of fibres which is then divided across its width into narrow ribbons which are passed between rubbing aprons to consolidate the fibres into rounded and continuous structures, called slubbings. Such slubbings and like loosely joined lengths of fibres for use in spinning processes may be completely untwisted or they may have a slight degree of twist or false twist sufficient to enable them to be handled easily prior to spinning. Conventionally, slubbings may be provided with up to about one-half turn of twist per inch of length and as such they tend to have a low tensile strength and can easily be pulled apart by hand. The slubbings are then formed into yarns for weaving, knitting and other purposes by spinning processes and machinery, which can be quite complicated for commercial operations. The strength of the finished yarn is in most instances determined by the extent or degree of twisting of the fibres into their interlocked form i.e. the tighter the twist, the stronger the finished yarn. However, the tighter twisting also reduces the thickness of the finished yarn and creates a 'hardness' to fabrics woven from or articles knitted with such tight spun yarns. In the case of natural wool like fibre yarns and fabrics or articles produced therefrom, there is a loss of the desirable springy soft feel and thermal insulation qualities inherent with unspun or partially spun fibre yarns and fabrics/articles produced therewith.

A further problem with typical spun yarns (being a problem that increases with tighter spinning), is that when released from the tension applicable when the yarn is wound into a tight ball or onto a bobbin i.e. on unwinding for use in fabric or article forming, there is the tendency of the yarn to at least partially untwist. This can lead to entanglement and/or difficulties in feed to needles and/or machinery for processing; and in some instances can create a tendency in a finished fabric or article to twist out of the desired finished shape. Similarly, fibrous ropes, strings, cords and the like formed with tightly spun fibres in a similar manner to spun yarns can be prone to a partial untwisting tendency and entanglement when released from a coil.

Hereinafter, for ease of reference, articles conventionally produced by the spinning processes described above will be referred to by the term "spun yarns".

U.S. Pat. No. 4,003,194 discloses a yarn with a core of false-twisted or loosely twisted or untwisted fibres and a wrapping of threads or fibres helically wound in one direction around the outside of the core. In this arrangement, as there is relative twist between the core and the wrapping, the wrapping tends to untwist if the yarn is cut or snagged.

U.S. Pat. No. 3,458,987 discloses a variation of this type of yarn structure in which the wrapping is formed from threads helically wound in opposite directions around the core, and the wrapping threads are melted or glued so that they adhere to each other at their cross-over points. Due to the complexity of this arrangement, the manufacturing process is very expensive and the yarn is produced at a relatively low rate.

In New Zealand Patent No. 194391, the present inventor addressed the problems associated with the prior art by providing an unspun yarn with an interlocked stitched cover to provide constraint and support for the fibre assembly or core. It will be apparent to the person skilled in the art that the production of such yarn is largely dependent upon the speed of operation of the stitch-forming machine. Here again, the production rate can be relatively low.

An object of the present invention is to provide an unspun fibre yarn having equal or greater strength than many conventional spun fibre yarns (produced from similar fibres), and without the inherent tendency to twist or untwist common to such conventional spun yarns.

Another object of the invention is to provide a method and means for producing a relatively high strength yarn utilising predominantly loosely joined drawn or carded fibres (slubbings) in conjunction with longitudinal reinforcing threads and without spinning in the conventional manner on conventional yarn spinning machinery, so that the end product yarn retains the fibres in a relatively loose format secured against accidental lateral and longitudinal separation.

Further objects of the invention are to provide a versatile unspun fibre high strength yarn capable of high speed and relatively low cost production in comparison with conventionally spun yarns, and to provide the method and machinery by which the unspun fibre yarn can be produced.

Other and more particular objects and advantages of the invention will become apparent from the ensuing description.

DISCLOSURE OF INVENTION

According to a first aspect of this invention there is provided an unspun yarn comprising a longitudinal main rope body, formed from at least one fibre assembly of substantially untwisted and parallel fibres, and at least one reinforcing thread helically wound around said main rope body and extending there along in a single longitudinal direction, wherein at predetermined intervals the direction in which the reinforcing thread is wound around said main rope body is reversed. The provision of a reinforcing thread wrapped around the main rope body in this manner confines the fibres against complete separation whilst enabling the fibres to retain their inherent springiness and some freedom of movement relative to adjacent fibres.

Preferably, two such reinforcing threads are provided about the main rope body, a first such thread being wound in one direction and the other being wound in the opposite direction in longitudinal juxtaposition with the first reinforcing thread.

Furthermore, a longitudinal reinforcing core thread may be incorporated within the main rope body. Preferably the core thread is crimped to allow at least some longitudinal stretch of the unspun yarn.

The fibres used in the fibre assembly may all be of one single type. Alternately, a combination of fibres having different characteristics may be employed. For example, the fibres may vary in their colours, strengths, textures or origin. In a similar manner, where more than one fibre assembly is used to form the main rope body, the fibre assemblies may have different characteristics.

Preferably, any reinforcing thread incorporated in the unspun yarn is of a neutral colour so as to tone in with the main rope body.

According to a second aspect of the present invention, there is provided a method of forming an unspun yarn comprising the steps of providing at least one continuous or substantially continuous fibre assembly of substantially untwisted and parallel fibres, providing at least one continuous or substantially continuous source of a reinforcing thread, forming the or each said fibre assembly into a longitudinal main rope body; intermittently imparting opposing twists to alternate sections of the main rope body whilst drawing a first reinforcing thread longitudinally into surface contact with a twisted section of the main rope, allowing the twisted section of the main rope body to engage the adjacent section of the first reinforcing thread, releasing the opposing twists in the twisted section of the rope body causing the engaged first reinforcing thread to wrap around the section of the main rope body.

In a further aspect, the invention provides an apparatus for producing an unspun yarn comprising a supply source for a longitudinal main rope body formed from at least one fibre assembly of substantially untwisted and parallel fibres, at least one partial twist means through which the main rope body is to be passed from the supply source via a first guide means in juxtaposition with said twist means, drive means for operating said twist means to cause intermittent reverse operation to impart a twist in one direction to longitudinal first sections of said main rope body alternating with a twist in the opposite direction of longitudinal second sections of said main rope body intermediate said the first sections, second guide means positioned beside said twist means arranged to locate and guide a reinforcing thread from a supply source into helical wrapping engagement longitudinally about said main rope body as the main rope body passes through the partial twist means and drawing means for drawing said main rope body and reinforcing thread through said partial twist means.

BRIEF DESCRIPTION OF DRAWINGS

Some preferred aspects of the invention will be described by way of example and with reference to the accompanying drawings, in which.

DESCRIPTION OF INVENTION

Figure 1:
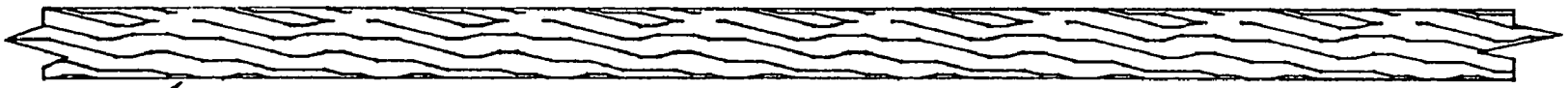
FIG. 1 is a diagrammatic enlargement of a section of a typical rope of the drawn fibres forming the base main rope body part of the unspun reinforced yarn to be formed.

Whilst not confined to such applications, the invention is particularly applicable to and will be described with reference to fibre yarns formed with natural wool fibres, which are renowned for the production of knitting and weaving yarns and have excellent wear, thermal insulation and other desirable qualities; such fibres have an inherent springiness and are readily formed and bonded into yarns (normally by spinning and twisting the fibres all in the one helical direction). Prior to the spinning process the wool fibres are carded and formed in slubbings or long ropes of loosely longitudinally entwined fibres such as that diagrammatically shown in FIG. 1, and generally indicated by the arrow 1. Such slubbings 1 are employed as the base main confined rope body 1' in the yarns formed in accordance with the present invention.

Figure 2:
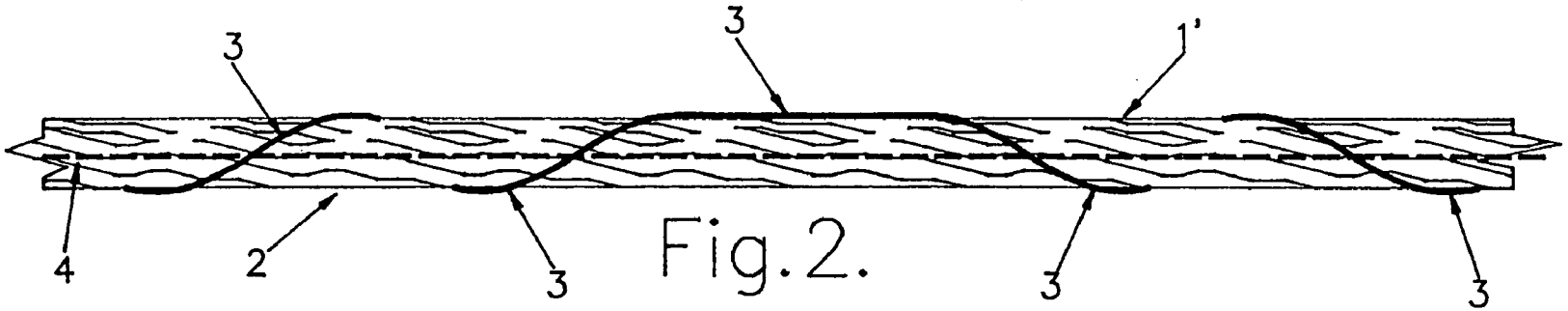
FIG. 2 is a diagrammatic slightly enlarged illustration of a length of the partially formed yarn with a single enwrapping reinforcing thread in accordance with the invention.

Contrary to conventional yarn production, in the present invention uses a fibre assembly such as a wool stubbing 1 which is not spun and permanently twisted, but is only subjected to a partial compression and partial twisting and untwisting in short longitudinal sections so that in the finished yarn state the wool fibres of the main rope body 1' remain substantially in their original longitudinally intermingled and joined slubbing state, varied only according to the extent of compression and drawing tension applied by the manufacturing method and apparatus as required for the final wool yarn thickness and intended purpose. The main rope body 1' per se thus has little tensile strength, and the desired higher strength of the finished yarn 2 is provided as shown in the first example of FIG. 2 by at least one reinforcing thread 3 which is wrapped externally about the main rope body 1' to restrict lateral separation of the fibres without preventing fibre movement within the general confines of the yarn nominal thickness. The reinforcing thread 3 can be a single filament of a synthetic material, but is preferably formed from a plurality of fine natural or synthetic fibres or filaments of any suitable kind having the desired finished thinness flexibility and tensile strength. As the yarn 2 is not spun in the usual manner, the reinforcing thread 3 is applied by laying alongside the main rope body 1' and twisting/un-twisting (or reverse twisting) short sections of the main rope body 1' of wool fibres. The arrangement allows a significant degree of longitudinal stretching and return to its original size (under the inherent 'clinging' and resilience or 'springiness' of the entwined or entangled wool fibres), whilst deterring longitudinal separation of the fibres and breaking of the finished yarn 2. If required, added tensile strength to the yarn 2 can be obtained with the provision of a core reinforcing thread (as indicated in broken line 4) within the stubbing 1 and main rope body 1'; but as a plain core thread 4 would prevent any longitudinal stretching of the finished wool yarn 2, it would be preferable that any such core thread 4 be crimped to allow at least some stretch and return in the finished yarn 2.

Figure 3:
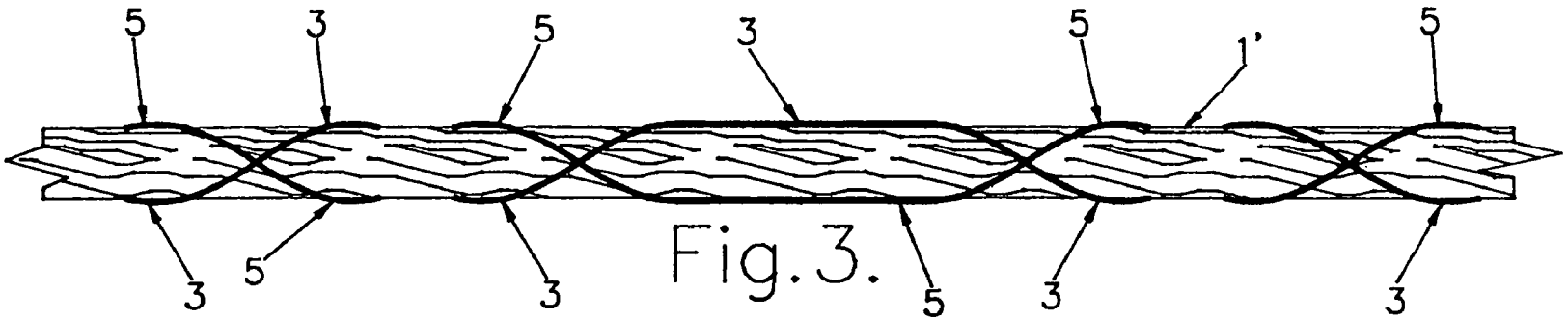
FIG. 3 is a diagrammatic illustration similar to FIG. 2, but with two enwrapping reinforcing threads in accordance with the invention.

With reference to FIG. 3 of the drawings, for improved lateral confining of the wool fibres against undue separation, and for improved tensile strength without unduly restricting longitudinal stretch and return of the finished yarn 2, two externally applied and wrapped reinforcing threads 3 and 5 are provided; th second external reinforcing thread 5 being applied in counter helical directions to those of the first external reinforcing thread 3 to assist in retention in position of such first thread 3.

Figure 4:
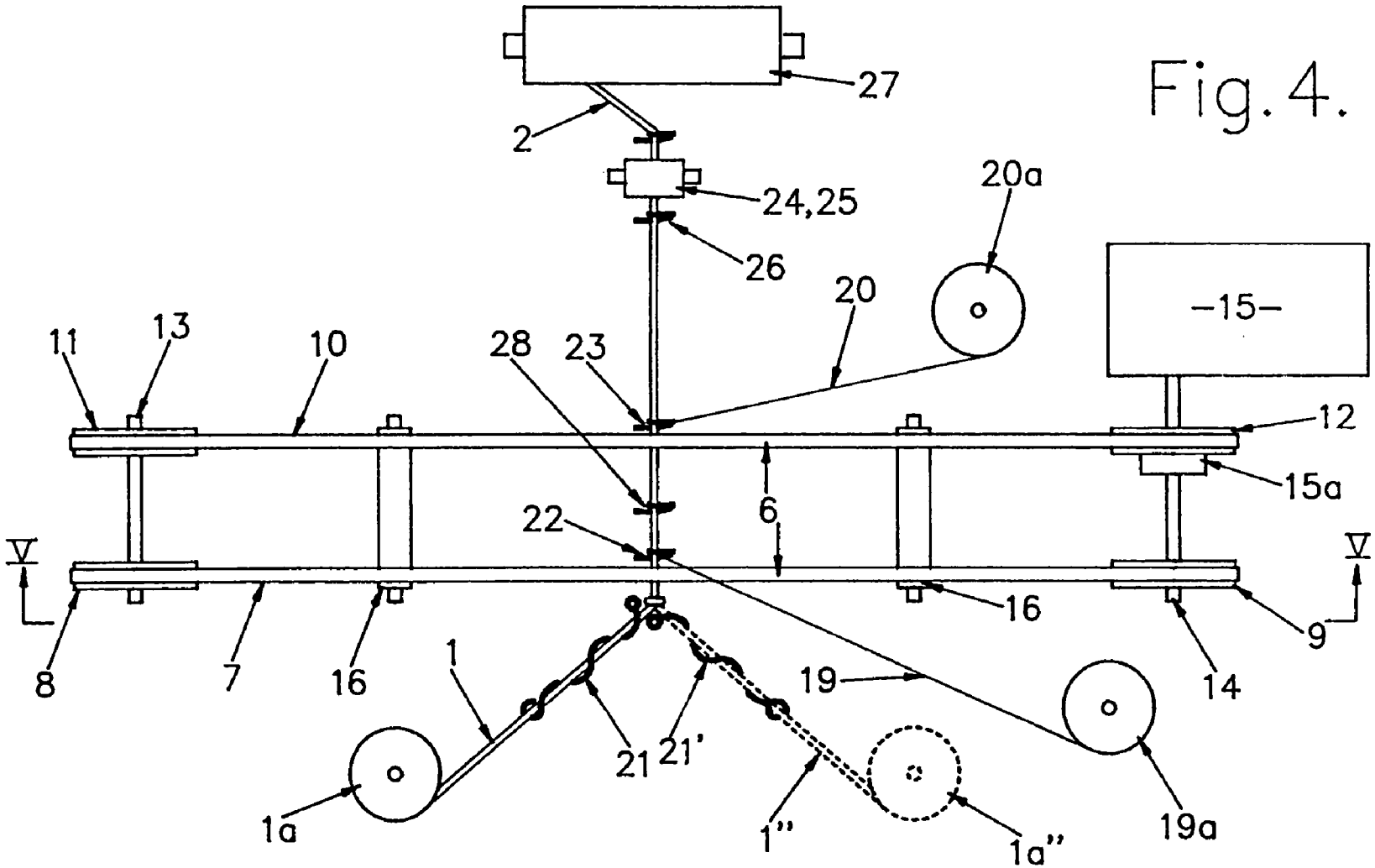
FIG. 4 is a plan view diagrammatically illustrating one form of apparatus in accordance with the invention.
Figure 5:
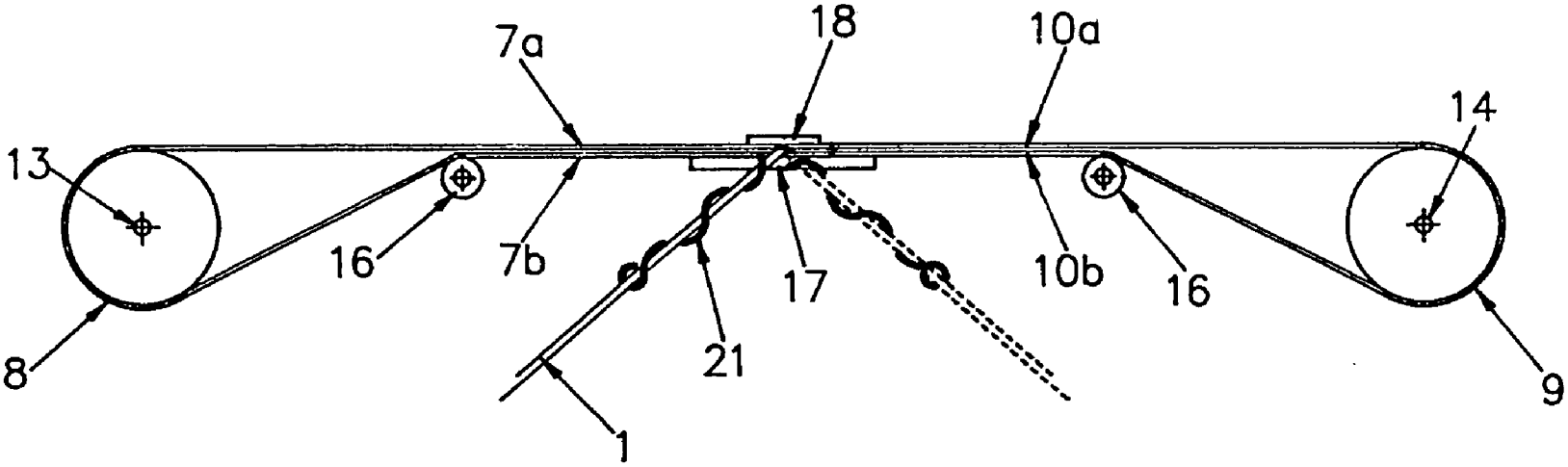
FIG. 5 is a view in the direction of arrows V—V of FIG. 4.

Referring now to FIGS. 4 and 5 of the drawings, one form of apparatus for performing the method and producing the yarn 2 of this invention includes support means (not shown) of any suitable kind and construction mounting a pair of similar endless loop belt and pulley arrangements (generally indicated by the arrow 6) which are arranged to impart some initial compression of and partial twist to the main rope body 1' and enable the reinforcing threads 3 and 5 to be twisted and wrapped about the main rope body 1'. The belt and pulley arrangement 6 includes a first input belt 7 (e.g. a Vee section belt) located about a freely rotatable pulley wheel 8 and a driven pulley wheel 9, and a second similar output belt 10 located about a freely rotatable pulley wheel 11 and a driven pulley wheel 12. Pulley wheels 8 and 11 can be on a common horizontal transverse axle 13 (or be separately mounted with a common axis), and the drive pulley wheels 9 and 12 can be located on a common axis 14 parallel with axle 13 and driven by a common power source or main common transmission 15 operated by any suitable power source (not shown) for intermittent reversible rotating of the drive pulley wheels 9 and 12. However, the arrangement includes intermediate transmission means 15*a* whereby the input belt drive pulley 9 operates in the reverse direction to that of the output belt drive pulley wheel 12, so the upper and lower runs 7*a*, 7*b* of the input belt 7 are reciprocally movable in the opposite directions to those of the upper and lower runs 10*a*, 10*b* of the output belt 10 for the purpose hereinafter described.

For the single yarn 2 production exampled, the medial portions of the lower belt runs 7*b*, 10*b* are raised into close proximity with the respective upper belt runs 7*a*, 10*a* such as by location over a pair of spaced freely rotatable intermediate rollers 16; the lower belt runs 7*b*, 10*b* passing over a lower support member 17, and there being an upper pressure bar or plate member 18 located in vertically adjustable parallel relationship thereover and above the upper belt runs 7*a*, 10*a* to enable an operator to load the apparatus with the required slubbing(s) 1 and reinforcing threads 19 and 20 (two reinforcing threads in this illustration) and make adjustments as required for the slubbing 1 thickness and desired effective belt pressure thereon.

The slubbing 1 and reinforcing threads 19, 20 are supplied to belts 7 and 10 from suitable continuous (or substantially continuous) supply sources, such as rotatably mounted bobbins or reels 1*a*, 19*a* and 20*a*, respectively, of the slubbing 1 and threads 19, 20. Preferably, there are any suitable tension and/or reel rotation retarding means (not shown) to maintain the slubbing 1 and threads 19, 20 under slight tension for smooth operation and prevent unwanted unravelling during operation of the apparatus. The stubbing 1 is fed to the input belt via a first helical or spiral wire guide 21 mounted on the lower support member 17. FIGS. 4 and 5 illustrate a further similar helical or spiral wire guide 21' not in use, whereby a second supply of the same or a different colour 1" or any other decorative or reinforcing yarn or thread from a supply source 1*a*" can be incorporated in the yarn to be produced. A first reinforcing thread 19 is supplied to the portion or section of the slubbing 1/main rope body 1' between the two belts 7 and 10 via a loop guide 22 mounted on the support member 17 close to the inner side of the input belt 7; and the second reinforcing thread 20 is supplied to the combined stubbing 1/main rope body 1' via a next loop guide 23 positioned adjacent the output belt 10 at the yarn exit side thereof. A further main loop guide 28 for the stubbing 1/main rope body 1' and enwrapping first reinforcing thread can be provided on the support member 17 medially between the belts 7 and 10.

The yarn components, main rope body 1 and enwrapping (as hereinafter described) reinforcing threads 19 and 20, are drawn under prescribed (adjustable to suit) tension through and from the partial compressing and twist applying belt arrangement 6 by means of a pair of horizontal parallel axis co-operating compression rollers 24, 25 (via any suitable intermediate guide and/or tensioning means 26 as may be required for direction and/or yarn tension control). The rollers 24,25 can be driven by an independent power source or the same power source for operation of the belt arrangement 6. The finished yarn 2 is preferably wound onto a large driven spool, bobbin, reel or like receiving means 27 for commercial use as is, or for subsequent re-distribution in small amounts in ball form or on smaller bobbins as may be required.

In operation of the apparatus (and performance of the yarn manufacturing method) a section of the slubbing1/main rope body 1' is drawn between the upper and lower runs 7*a*,7*b* and 10*a*,10*b* of the belts 7 and 10. Since the belts 7 and 10 are moving in opposite directions, as they grip either end of the section of the main rope body 1', they impart a twist therein. A first reinforcing thread 19 is positioned adjacent to and engages with the twisted section of the main rope body 1' and as the twist is released the reinforcing thread is wrapped helically about the main rope body 1'. This thus provides that the first reinforcing thread 19 wraps itself helically and fairly lightly about the section of stubbing 1/main rope body 1' drawn between the two belts 7 and 10, alternately first in one direction and then in the opposite direction; and as the combined main rope body 1' and enwrapping first reinforcing thread 19 continue through and exit from the output belt 10, the almost immediate untwisting of the combination (due to the inherent resilience and springiness of the wool fibres) causes the second reinforcing thread 20 supplied to the exit and untwist point to wrap around the main rope body 1' and first reinforcing thread in longer pitch helical sections, counter to the helical directions of the first reinforcing thread 19, to restrict unravelling of the latter.

Whilst the illustrated and described apparatus provides for the manufacture of a single yarn, it will be appreciated that a number of the yarns can be simultaneously produced on the one twin belt arrangement 6 with duplication of the yarn component partial compression and twist points, with the associated similar guides 21, 22 and 23, at spaced intervals along the length of the section of the belt runs 7*a*, 7*b* and 10*a*, 10*b* located in close proximity. A common support member 17 or separate support members 17 can be provided below the lower belt runs 7*b* and 10*b* for the respective points of twist and guides 21, 22 and 23, but preferably individual upper adjustable pressure members 18 are provided. Separate sources of supply 1*a*, 19*a* and 20*a* of the wool slubbings 1 and reinforcing threads 19 and 20 will then be provided for the respective yarns 2 to be formed.

In a modification of the invention the upper adjustable pressure members 18 can be dispensed with and replaced by rotatable cam members which intermittently bear on the upper surface of the upper belt runs 7*a* and 10*a* to urge such upper belt runs 7*a* and 10*a* into engagement with the slubbings 1 or main rope bodies 1'.

Figure 6:
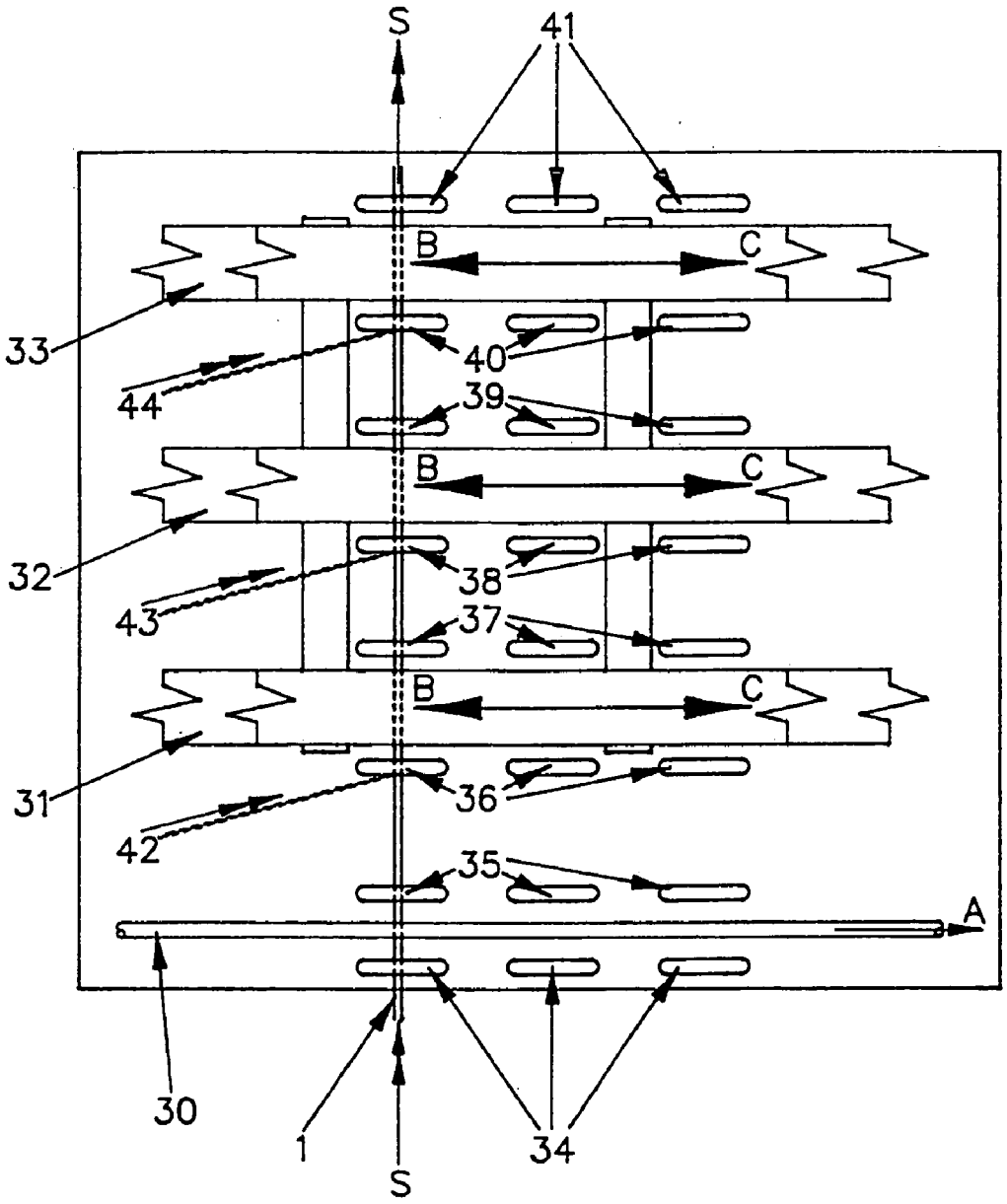
FIG. 6 is a plan view of a second embodiment of the apparatus of the present invention.

A second embodiment of the invention is shown in FIG. 6. In this embodiment, the general layout and operation of the apparatus are similar to FIGS. 4 and 5 except as specifically described below.

As shown in FIG. 6, the apparatus comprises a series of four parallel belts 30–33 inclusive, each driven between opposed pairs of drive pulleys (not shown) by any suitable drive means.

The first belt 30, is driven continuously in the direction of arrow A and is used to impart a first twist to a stubbing, as hereinafter described. The remaining three belts, 31–33 are reciprocated in the directions of arrows B/C, with all three belts 31–33 moving in the same direction at the same time.

Over the central portions of the runs of the belts 30–33, the upper and lower runs of the belts are pressed together by a pre-set amount, using any suitable means (not shown) e.g. a raised table underneath the lower run of the belt.

Three spaced parallel sets of loop guides 34–41 are arranged on each side of each belt 30–33, to guide a stubbing 1 as it passes through the belts.

In operation, a stubbing 1 is drawn through the apparatus in the direction of arrows 5, as described with reference to FIGS. 4 and 5. The stubbing passes through the loop guides 3–41. As the stubbing 1 passes through the belt 30, the friction between the belt and the slubbing imparts a twist to the slubbing, to give the slubbing some initial compression and cohesion. Most of this twist is lost as the stubbing progresses through the remainder of the apparatus.

At each of the remaining belts 31–33, the slubbing passes between the opposed runs of the reciprocating belts, so that the slubbing has one section twisted one way, then the next section twisted the other way as the slubbing moves relative to the reciprocating belts. All of this twisting produces a series of false twists in opposite directions along the length of the stubbing. As the stubbing leaves each belt, its natural resilience opposes the false twist imparted by the belt, and the stubbing starts to untwist Reinforcing threads 42, 43, 44 are fed through loop guides 36, 38, 40 respectively, adjacent the intake sides of each of the belts 31–33. Thus, the corresponding reinforcing thread lies adjacent the slubbing and is wrapped around the slubbing as the false twist is imparted by the corresponding belt, and is then wrapped still further as the slubbing starts to untwist after leaving the belt.

Figure 7:
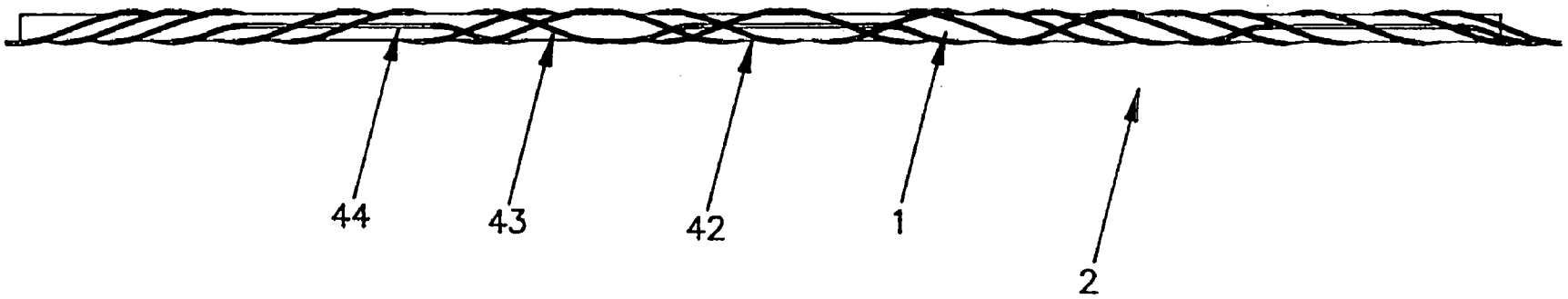
FIG. 7 is a diagrammatic enlargement of a yarn formed by the apparatus of FIG. 6.

The finished product emerging from the apparatus is shown in FIG. 7—the slubbing 1 is wrapped in the three reinforcing threads 42, 43, 44.

Although three false-twist belts 31–33 are shown, it will be appreciated that only a single such belt may be used, or additional false-twist belts may be added. Similarly, only a single reinforcing thread may be used, or any number of such threads, depending upon the required characteristics of the end product.

Up to three slubbings may be run through the apparatus at once, one for each set of loop guides 34–41. However, wider apparatus can be used to process more than three slubbings simultaneously.

The initial twist belt 30 may be omitted, depending upon the initial strength of the stubbing.

As spinning of the yarn does not take place, the apparatus or machinery required for production of the yarn in accordance with the invention is not as complicated as conventional yarn producing apparatus and significantly faster yarn production is possible; thus enabling considerable costs savings in production as well as providing a yarn having the anti twist finished structure and the other previously mentioned advantages of flexibility, softer feel and retention or maximising of the inherent wool fibre springiness and thermal insulation qualities.

The invention has been particularly described with reference to the production of wool fibre based yarns for knitting and weaving into articles, but it will be apparent that a considerable variety of types and thickness of yarns can be produced for various purposes, including tufted and looped carpet manufacture; and that the invention is similarly applicable to the economic manufacture of ropes and cords of various kinds. The yarns ropes and cords etc can be produced utilising a variety of fibres and fibre mixes, including crimped synthetic fibres or filaments for the main loose fibre rope body and the stronger thinner reinforcing threads.

Some preferred aspects of the invention have been described by way of example and many other variations of and modifications to the invention can take place without departing therefrom.

What is claimed is:

1. An unspun yarn comprising a longitudinal main rope body, formed from at least one fibre assembly of substantially untwisted and parallel fibres comprising wool rovings or slubbings, and at least one reinforcing thread helically wound around said main rope body and extending therealong in a single longitudinal direction, wherein at predetermined intervals the direction in which the reinforcing thread is wound around said main rope body is reversed.

2. An unspun yarn according to claim 1, wherein at least one second reinforcing thread is provided and helically wound around the main rope body.

3. An unspun yarn according to claim 1 or claim 2, wherein the main rope body further includes a longitudinal reinforcing core thread.

4. An unspun yarn according to claim 3, wherein the reinforcing core thread is crimped to permit longitudinal stretch thereof.

5. A method of forming an unspun yarn comprising the steps of providing at least one continuous or substantially continuous fibre assembly of substantially untwisted and parallel fibres, providing at least one continuous or substantially continuous source of a reinforcing thread, forming the or each said fibre assembly into a longitudinal main rope body; intermittently imparting opposing twists to alternate sections of the main rope body whilst drawing a first reinforcing thread longitudinally into surface contact with a twisted section of the main rope body, allowing the twisted section of the main rope body to engage the adjacent section of the first reinforcing thread, releasing the opposing twists in the twisted section of the rope body causing the engaged first reinforcing thread to wrap around the section of the main rope body.

6. A method according to claim 5, wherein a second reinforcing thread is separately drawn into engagement with an alternately twisted section of the combined main rope body and first reinforcing thread.

7. A method according to claim 5 or claim 6, further including the feeding together of two or more fibre assemblies to form said main rope body.

8. A method according to claim 7, wherein the fibre assemblies have differing characteristics.

9. A method according to claim 5, wherein a core reinforcing thread is introduced into the main rope body.

10. An apparatus for producing an unspun yarn comprising a first supply source for a longitudinal main rope body formed from at least one fibre assembly of substantially untwisted and parallel fibres, at least one partial twist means through which the main rope body is to be passed from the first supply source via a first guide means in juxtaposition with said twist means, drive means for operating said twist means to cause intermittent reverse operation to impart a twist in one direction to longitudinal first sections of said main rope body alternating with a twist in the opposite direction of longitudinal second sections of said main rope body intermediate said the first sections, second guide means positioned beside said twist means arranged to locate and guide a reinforcing thread from a second supply source into helical wrapping engagement longitudinally about said main rope body as the main rope body passes through the partial twist means and drawing means for drawing said main rope body and reinforcing thread through said partial twist means.

11. An apparatus according to claim 10 provided with a plurality of successive partial twist means and a means for introducing a separate reinforcing thread to the main rope body before it is drawn into each successive twist means.

12. An apparatus according to claim 10 or claim 11 wherein the or each partial twist means comprises a first input endless loop belt and a second output endless loop belt both located in spaced parallel relationship for intermittent reversible movement, said loop belts being arranged to grip and twist the main rope body as it passes transversely between the opposing runs of both the belts.

13. An unspun yarn comprising a longitudinal main rope body, formed from at least one fibre assembly of substantially untwisted and parallel fibres, including a longitudinal reinforcing core thread crimped to permit longitudinal stretch thereof, and at least one reinforcing thread helically wound around said main rope body and extending therealong in a single longitudinal direction, wherein at predetermined intervals the direction in which the reinforcing thread is wound around said main rope body is reversed.

14. An unspun yarn comprising a longitudinal main rope body, formed from at least one fibre assembly of substantially untwisted and parallel fibres, wherein a combination of different fibres are used, and at least one reinforcing thread helically wound around said main rope body and extending therealong in a single longitudinal direction, wherein at predetermined intervals the direction in which the reinforcing thread is wound around said main rope body is reversed.

* * * * *